US011423921B2

(12) United States Patent
Tateishi et al.

(10) Patent No.: US 11,423,921 B2
(45) Date of Patent: Aug. 23, 2022

(54) SIGNAL PROCESSING DEVICE, SIGNAL PROCESSING METHOD, AND PROGRAM

(71) Applicant: Sony Corporation, Tokyo (JP)

(72) Inventors: Kazuya Tateishi, Tokyo (JP); Shusuke Takahashi, Chiba (JP); Akira Takahashi, Saitama (JP); Kazuki Ochiai, Kanagawa (JP); Yoshiaki Oikawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 42 days.

(21) Appl. No.: 16/972,563

(22) PCT Filed: Apr. 22, 2019

(86) PCT No.: PCT/JP2019/017047
§ 371 (c)(1),
(2) Date: Dec. 4, 2020

(87) PCT Pub. No.: WO2019/239723
PCT Pub. Date: Dec. 19, 2019

(65) Prior Publication Data

US 2021/0241781 A1 Aug. 5, 2021

(30) Foreign Application Priority Data

Jun. 11, 2018 (JP) ..... JP2018-110998

(51) Int. Cl.
*G10L 21/0216* (2013.01)
*H04R 3/00* (2006.01)
(Continued)

(52) U.S. Cl.
CPC ..... *G10L 21/0216* (2013.01); *H04R 3/005* (2013.01); *H04R 3/02* (2013.01); *G10L 2021/02082* (2013.01)

(58) Field of Classification Search
CPC ..... G10L 21/0216; G10L 2021/02082; H04R 3/005; H04R 3/02
(Continued)

(56) References Cited

U.S. PATENT DOCUMENTS 5,796,819 A 8/1998 Romesburg
6,148,078 A 11/2000 Romesburg
(Continued)

FOREIGN PATENT DOCUMENTS

CN 1798217 A 7/2006
DE 2207141 8/1973
(Continued)

OTHER PUBLICATIONS

International Search Report and English translation thereof dated Jun. 18, 2019 in connection with International Application No. PCT/JP2019/017047.
(Continued)

*Primary Examiner* — Paul Kim
(74) *Attorney, Agent, or Firm* — Wolf, Greenfield & Sacks, P.C.

(57) ABSTRACT

Compensation accuracy is increased with respect to clip compensation in a case where signals from a plurality of microphones are subjected to an echo cancellation process. A signal processing device according to an embodiment of the present technology includes an echo cancellation unit that performs an echo cancellation process of canceling an output signal component from a speaker on signals from a plurality of microphones, a clip detection unit that performs a clip detection for signals from the plurality of microphones, and a clip compensation unit that compensates for a signal after the echo cancellation process of clipped one of the microphones on the basis of a signal of non-clipped one of the microphones.

9 Claims, 10 Drawing Sheets

(51) Int. Cl.
*H04R 3/02* (2006.01)
*G10L 21/0208* (2013.01)

(58) Field of Classification Search
USPC ..... 381/66
See application file for complete search history.

(56) References Cited

U.S. PATENT DOCUMENTS

| | | | | |
|---|---|---|---|---|
| 6,507,653 | B1 | 1/2003 | Romesburg | |
| 2003/0026437 | A1 | 2/2003 | Janse et al. | |
| 2003/0076948 | A1 | 4/2003 | Nishimura | |
| 2006/0147063 | A1 | 7/2006 | Chen | |
| 2006/0210096 | A1* | 9/2006 | Stokes, III | H03G 3/3089 381/104 |
| 2007/0165838 | A1 | 7/2007 | Li et al. | |
| 2007/0274535 | A1 | 11/2007 | Mao | |
| 2010/0074434 | A1 | 3/2010 | Kobayashi | |
| 2010/0254545 | A1 | 10/2010 | Hosomi | |
| 2012/0109632 | A1 | 5/2012 | Sugiura et al. | |
| 2016/0196818 | A1 | 7/2016 | Christoph | |
| 2016/0205263 | A1 | 7/2016 | Liu et al. | |

FOREIGN PATENT DOCUMENTS

| | | | |
|---|---|---|---|
| EP | 1703774 | A2 | 9/2006 |
| EP | 1703774 | A2 | 9/2006 |
| GB | 9907912 | A | 3/2000 |
| JP | 2005-065217 | A | 3/2005 |
| JP | 2010-245657 | A | 10/2010 |
| JP | 2012-093641 | A | 5/2012 |
| JP | 2017-011541 | A | 1/2017 |
| WO | 92/12583 | A | 7/1992 |
| WO | WO-9935812 | A1 | 7/1999 |
| WO | WO-9935813 | A1 | 7/1999 |

OTHER PUBLICATIONS

Written Opinion and English translation thereof dated Jun. 18, 2019 in connection with International Application No. PCT/JP2019/017047.

International Preliminary Report on Patentability and English translation thereof dated Dec. 24, 2020 in connection with International Application No. PCT/JP2019/017047.

Yong, The Application of Echo Cancellation Technology in the Bluetooth Hands-free System. Journal of Heilongjiang Hydraulic Engineering College. Mar. 2008:35;112-15.

Yue et al., Optimization of Echo Cancellation Based on Qualcomm. Journal of Data Acquisition & Processing. Jan. 2012:27;102-5.

* cited by examiner

FIG. 10

| | SPEAKER OUTPUT | USER SPEECH | CAUSE OF CLIP | PROCESS |
|---|---|---|---|---|
| CASE 1 | PRESENT | PRESENT | DOUBLE TALK | ADJUST SUPPRESSION AMOUNT ACCORDING TO USER SPEECH WHILE PERFORMING CLIP COMPENSATION |
| CASE 2 | PRESENT | NONE | SNEAK INTO SPEAKER | PERFORM CLIP COMPENSATION |
| CASE 3 | NONE | PRESENT | USER SPEECH | PROCESS CORRESPONDING TO RECOGNITION ENGINE (OR NO COMPENSATION) |
| CASE 4 | NONE | NONE | NOISE | NO COMPENSATION DISCARDED BEFORE VOICE RECOGNITION |

FIG. 11

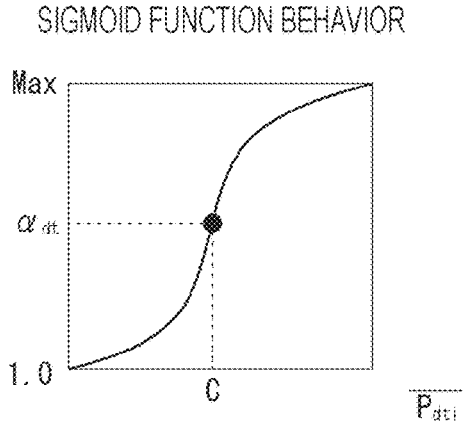

SIGNAL PROCESSING DEVICE, SIGNAL PROCESSING METHOD, AND PROGRAM

CROSS REFERENCE TO RELATED APPLICATIONS

This is a U.S. National Stage Application under 35 U.S.C. §371, based on International Application No. PCT/JP2019/017047, filed Apr. 22, 2019, which claims priority to Japanese Patent Application JP 2018-110998, filed Jun. 11, 2018, each of which is hereby incorporated by reference in its entirety.

TECHNICAL FIELD

The present technology relates to a signal processing device that performs signal processing on signals from a plurality of microphones, a method thereof, and a program, and particularly relates to a technique to compensate for a signal of a clipped microphone when performing an echo cancellation process on signals of a plurality of microphones.

BACKGROUND ART

In recent years, devices called smart speakers and the like in which a plurality of microphones and a speaker are provided in the same casing have become widespread. Some devices of this type estimate a speech direction of a user or speech content (voice recognition) on the basis of signals from a plurality of microphones. Operations such as directing the front of the device to the user speech direction on the basis of the estimated speech direction, having a conversation with the user on the basis of a voice recognition result, and the like have been achieved.

In this type of device, the positions of the plurality of microphones are usually closer to the speaker compared to the position of the user, and during loud sound reproduction by the speaker, in a process of A/D converting a signal of a microphone, a phenomenon called a clip occurs in which quantized data sticks to a maximum value.

Note that as a related conventional technique, Patent Document 1 below discloses a technique that achieves, in a system for recording signals from a plurality of microphones, clip compensation by replacing the waveform of a clipped portion in a signal of a clipped microphone with the waveform of a signal of a non-clipped microphone.

CITATION LIST

Patent Document

Patent Document 1: Japanese Patent Application Laid-Open No. 2010-245657

SUMMARY OF THE INVENTION

Problems to be Solved by the Invention

Here, in the device such as a smart speaker, an echo cancellation process may be performed to suppress an output signal component of the speaker included in signals from a plurality of microphones. By performing such an echo cancellation process, it is possible to improve accuracy of speech direction estimation and voice recognition under sound output performed by the speaker.

The present technology has been made in view of the above circumstances, and an object thereof is to increase compensation accuracy with respect to clip compensation in a case where signals from a plurality of microphones are subjected to an echo cancellation process.

Solutions to Problems

A signal processing device according to an embodiment of the present technology includes an echo cancellation unit that performs an echo cancellation process of canceling an output signal component from a speaker on signals from a plurality of microphones, a clip detection unit that performs a clip detection for signals from the plurality of microphones, and a clip compensation unit that compensates for a signal after the echo cancellation process of clipped one of the microphones on the basis of a signal of non-clipped one of the microphones.

In a case where the echo cancellation process is performed on signals from the plurality of microphones, when the clip compensation is performed on a signal before the echo cancellation process, the clip compensation is performed in a state that an output signal component of the speaker and other components including a target sound are difficult separate, and thus clip compensation accuracy tends to decrease. By performing the clip compensation on the signal after the echo cancellation process as described above, it is possible to perform the clip compensation on a signal in which the output signal component of the speaker is suppressed to some extent.

In the signal processing device described above according to the present technology, it is desirable that the clip compensation unit compensates for a signal of the clipped microphone by suppressing the signal.

By employing a compensation method of suppressing the signal of the clipped microphone, it is possible to prevent phase information of the signal of the clipped microphone from being lost by the compensation.

In the signal processing device described above according to the present technology, it is desirable that the clip compensation unit suppresses a signal of the clipped microphone on the basis of an average power ratio between a signal of the non-clipped microphone and a signal of the clipped microphone.

Thus, power of the signal of the clipped microphone can be appropriately suppressed to power after the echo cancellation process that has to be obtained in a case where it is not clipped.

In the signal processing device described above according to the present technology, it is desirable that the clip compensation unit uses, as the average power ratio, an average power ratio with a signal of the microphone having a minimum average power among the signals of the non-clipped microphones is used.

The microphone with the minimum average power can be restated as the microphone in which it is most difficult for clipping to occur.

In the signal processing device described above according to the present technology, it is desirable that the clip compensation unit adjusts a suppression amount of a signal of the clipped microphone according to a speech level in a case where a user speech is present and a speaker output is present.

In what is called a double talk section in which a user speech is present and a speaker output is present, if the speech level of the user is high, the speech component is also included in a large amount even in the noise superposed section due to clipping (note that the double talk mentioned here means that the user speech and the speaker output overlap in time as illustrated in FIG. 9). On the other hand, in a case where the speech level is low, the speech component tends to be buried in large clipping noise. Accordingly, in the double talk section, the suppression amount of the signal of the clipped microphone is adjusted according to the speech level.

Thus, if the speech level of the user is high, it is possible to reduce the suppression amount of the signal to prevent the speech component from being suppressed, and when the speech level of the user is low, it is possible to increase the suppression amount of the signal to suppress the clipping noise.

In the signal processing device described above according to the present technology, it is desirable that the clip compensation unit suppresses a signal of the clipped microphone by a suppression amount according to a characteristic of a voice recognition process in a subsequent stage in a case where a user speech is present and no speaker output is present.

The case where a user speech is present and no speaker output is present is a case where a cause of a clip is estimated to be the user speech. With the above configuration, in the case where the cause of the clip is estimated to be the user speech, for example, it is possible to perform the clip compensation with an appropriate suppression amount according to characteristics of the voice recognition process in the subsequent stage such that the voice recognition accuracy can be maintained better in a case where there is a certain degree of speech level even if clipping noise is superposed than in a case where the speech component is suppressed, or the like.

In the signal processing device described above according to the present technology, it is desirable that the clip compensation unit does not perform the compensation for the clipped microphone signal in a case where a user speech is present and no speaker output is present.

In the case where the user speech is present and the speaker output is not present, that is, a case where the cause of the clip is estimated to be the user speech, it is empirically known that not suppressing the signal can result in a more favorable voice recognition result in the subsequent stage. In such a case, it is possible to improve the voice recognition accuracy by not performing the clip compensation as described above.

In the signal processing device described above according to the present technology, it is desirable to further includes a drive unit that changes a position of at least one of the plurality of microphones or the speaker, and a control unit that changes the position of at least one of the plurality of microphones or the speaker by the drive unit in response to detection of a clip by the clip detection unit.

Thus, if a clip is detected, it is possible to change the positional relationship among the respective microphones and the speaker, or move the positions of the plurality of microphones or the speaker to a position where wall reflection or the like is small.

Further, a signal processing method according to the present technology includes an echo cancellation procedure to perform an echo cancellation process of canceling an output signal component from a speaker on signals from a plurality of microphones, a clip detection procedure to perform a clip detection for signals from the plurality of microphones, and a clip compensation procedure to compensate for a signal after the echo cancellation process of clipped one of the microphones on the basis of a signal of non-clipped one of the microphones.

Also with such a signal processing method, operations similar to those of the signal processing device described above according to the present technology can be obtained.

Moreover, a program according to the present technology is a program executed by an information processing device, the program causing the information processing device to implement functions including an echo cancellation function to perform an echo cancellation process of canceling an output signal component from a speaker on signals from a plurality of microphones, a clip detection function to perform a clip detection for signals from the plurality of microphones, and a clip compensation function to compensate for a signal after the echo cancellation process of clipped one of the microphones on the basis of a signal of non-clipped one of the microphones.

The signal processing device according to such present technology described above is achieved by a program according to the present technology.

Effects of the Invention

With the present technology, it is possible to increase compensation accuracy with respect to clip compensation in a case where signals from a plurality of microphones are subjected to an echo cancellation process.

Note that the effect described here is not necessarily limited, and may be any effect described in the present disclosure.

BRIEF DESCRIPTION OF DRAWINGS

FIG. 10 is an explanatory diagram for selectively executing a process related to clip compensation in each case.

FIG. 11 is a diagram illustrating a behavior of a sigmoid function employed in the embodiment.

MODE FOR CARRYING OUT THE INVENTION

Hereinafter, an embodiment according to the present technology will be described in the following order with reference to the accompanying drawings.

<1. External appearance configuration of signal processing device>

<2. Electrical configuration of signal processing device>

<3. Operation of signal processing device>

<4. Echo cancellation method in embodiment>

<5. Clip compensation method as embodiment>

<6. Processing procedure>

<7. Modification example>

<8. Summary of embodiment>

<9. Present technology>

<1. External Appearance Configuration of Signal Processing Device>

Figure 1:
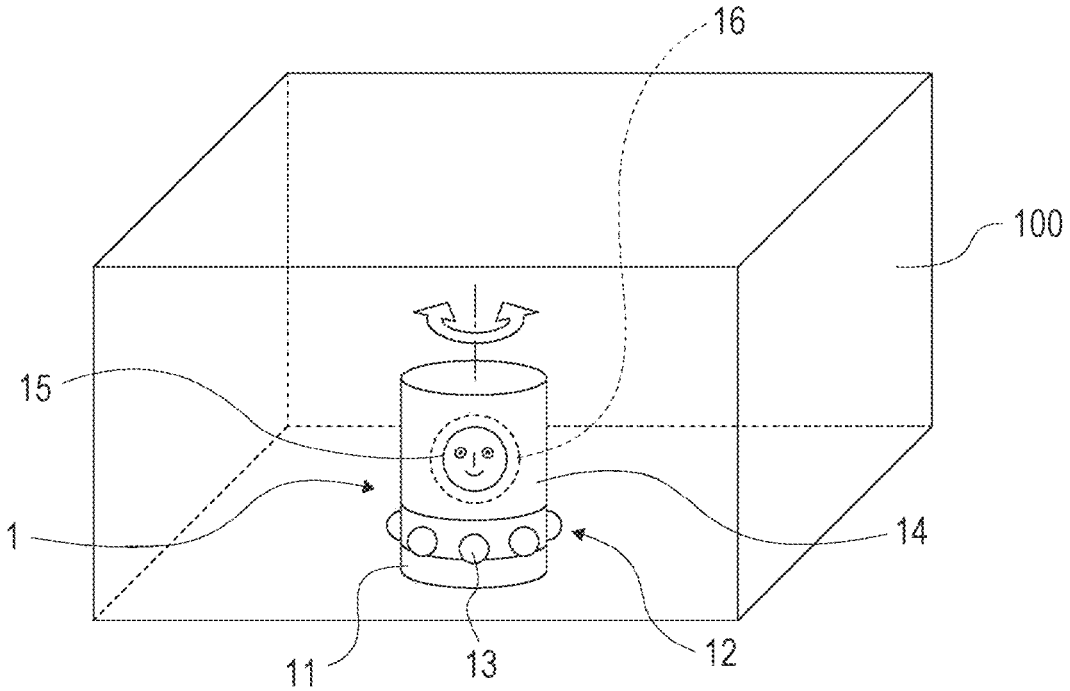
FIG. 1 is a perspective view illustrating an external appearance configuration example of a signal processing device as an embodiment according to the present technology.

FIG. 1 is a perspective view illustrating an external appearance configuration example of a signal processing device 1 as an embodiment according to the present technology.

As illustrated in the diagram, the signal processing device 1 includes a substantially columnar casing 11 and a substantially columnar movable unit 14 located above the casing 11.

The movable unit 14 is supported by the casing 11 so as to be rotatable in the direction indicated by an outline double-headed arrow in the diagram (rotation in a pan direction). The casing 11 does not rotate in conjunction with the movable unit 14, for example, in a state of being placed on a predetermined position of a table, a floor, or the like, and forms what is called a fixed portion.

The movable unit 14 is rotationally driven by a servo motor 21 (described later with reference to FIG. 3) incorporated in the signal processing device 1 as a drive unit.

A microphone array 12 is provided at an upper end of the casing 11.

Figure 2:
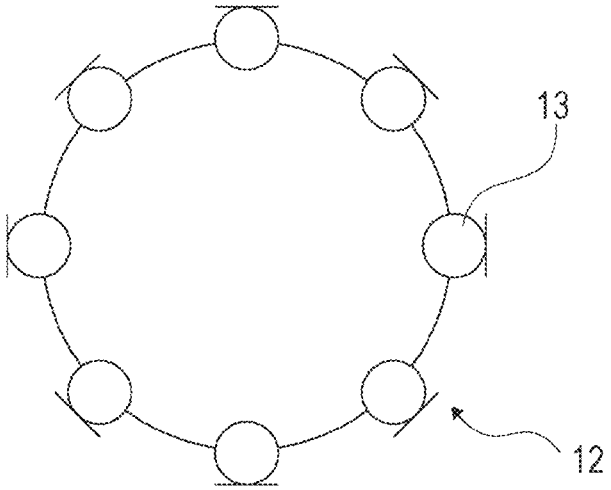
FIG. 2 is an explanatory diagram of a microphone array included in the signal processing device as the embodiment.

As illustrated in FIG. 2, the microphone array 12 is configured by arranging a plurality of (eight in the example of FIG. 2) microphones 13 on a circumference at substantially equal intervals.

Since the microphone array 12 is provided on the casing 11 side rather than on the movable unit 14 side, the position of each microphone 13 remains unchanged even when the movable unit 14 rotates. That is, the position of each microphone 13 in the space 100 does not change even when the movable unit 14 rotates.

The movable unit 14 is provided with a display unit 15 including, for example, a liquid crystal display (LCD), an electro-luminescence (EL) display, or the like. In this example, a picture of a face is displayed on the display unit 15, and the direction in which the face faces is a front direction of the signal processing device 1. As will be described later, the movable unit 14 is rotated so that the display unit 15 faces the speech direction, for example.

Further, in the movable unit 14, a speaker 16 is housed on a back side of the display unit 15. The speaker 16 outputs sounds such as a message and music to the user.

The signal processing device 1 as described above is arranged in, for example, a space 100 such as a room.

The signal processing device 1 is incorporated in, for example, a smart speaker, a voice agent, a robot, or the like, and has a function of estimating the speech direction of a voice when the voice is emitted from a surrounding sound source (for example, a person). The estimated direction is used to direct the front of the signal processing device 1 toward the speech direction.

<2. Electrical Configuration of Signal Processing Device>

Figure 3:
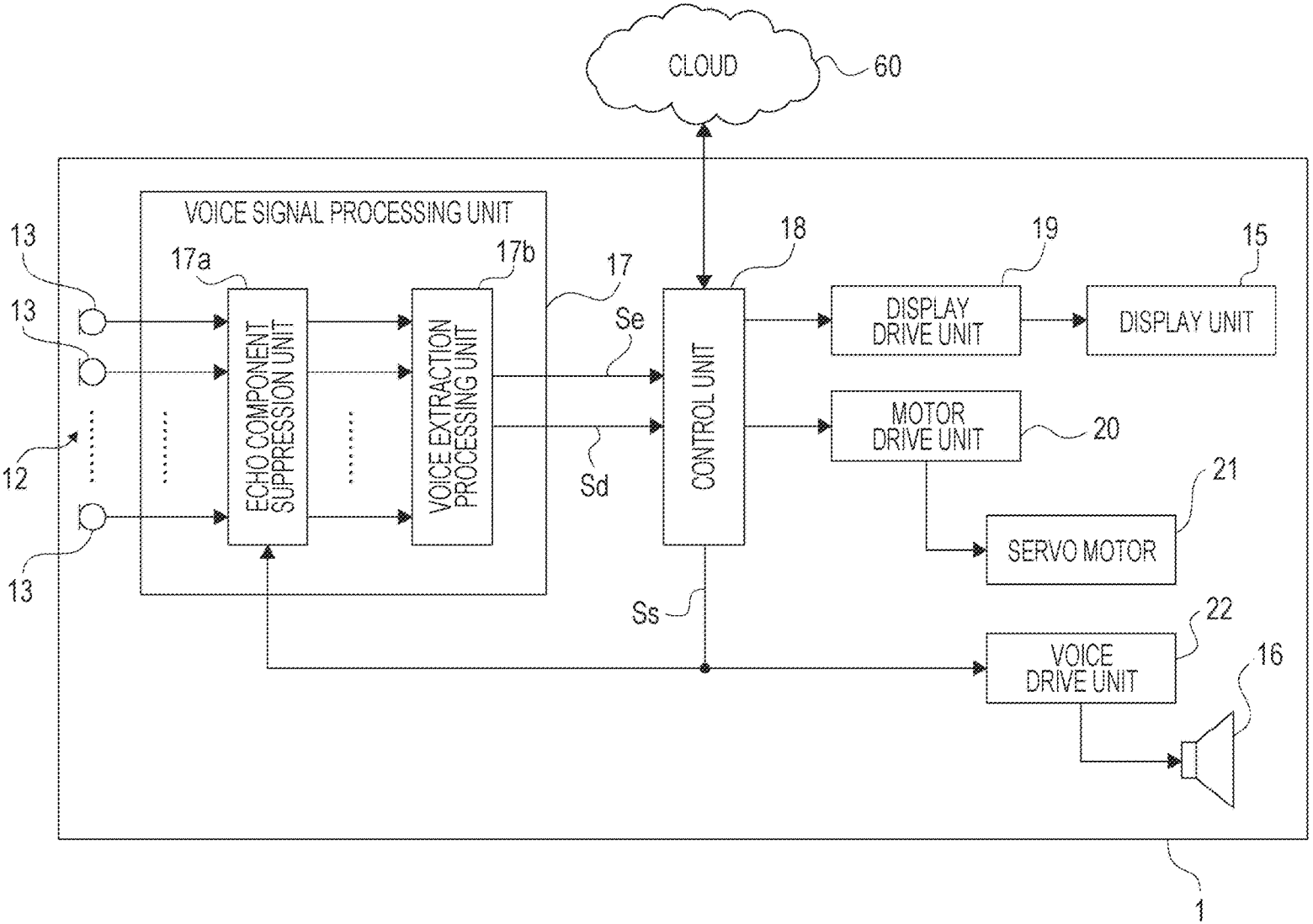
FIG. 3 is a block diagram for explaining an electrical configuration example of the signal processing device as the embodiment.

FIG. 3 is a block diagram for explaining an electrical configuration example of the signal processing device 1.

As illustrated in the diagram, the signal processing device 1 includes, together with the microphone array 12, the display unit 15, and the speaker 16 illustrated in FIG. 1, a voice signal processing unit 17, a control unit 18, a display drive unit 19, a motor drive unit 20, and a voice drive unit 22.

The voice signal processing unit 17 can include, for example, a digital signal processor (DSP), or a computer device having a central processing unit (CPU), or the like, and processes a signal from each microphone 13 in the microphone array 12.

Note that although not illustrated, the signal from each microphone 13 is analog-digital converted by an A-D converter and then input to the voice signal processing unit 17.

The voice signal processing unit 17 includes an echo component suppression unit 17*a* and a voice extraction processing unit 17*b*, and a signal from each microphone 13 is input to the voice extraction processing unit 17*b* via the echo component suppression unit 17*a*.

The echo component suppression unit 17*a* performs an echo cancellation process for suppressing an output signal component from the speaker 16 included in the signal of each microphone 13, using an output voice signal Ss described later as a reference signal. Note that the echo component suppression unit 17*a* of this example performs clip compensation for the signal from each microphone 13, which will be described later.

The voice extraction processing unit 17*b* performs extraction of a target sound (voice extraction) by estimating the speech direction, emphasizing the signal of the target sound, and suppressing noise on the basis of the signal of each microphone 13 input via the echo component suppression unit 17*a*. The voice extraction processing unit 17*b* outputs an extracted voice signal Se to the control unit 18 as a signal obtained by extracting the target sound. Further, the voice extraction processing unit 17*b* outputs information indicating the estimated speech direction to the control unit 18 as speech direction information Sd.

Note that details of the voice extraction processing unit 17*b* will be described again.

The control unit 18 includes a microcomputer having, for example, a CPU, a read only memory (ROM), a random access memory (RAM), and the like, and performs overall control of the signal processing device 1 by executing a process according to a program stored in the ROM.

For example, the control unit 18 performs control related to display of information by the display unit 15. Specifically, an instruction is given to the display drive unit 19 having a driver circuit for driving display of the display unit 15 to cause the display unit 15 to execute display of various types of information.

Further, the control unit 18 of this example includes a voice recognition engine that is not illustrated, and performs a voice recognition process on the basis of the extracted voice signal Se input from the voice signal processing unit 17 (voice extraction processing unit 17*b*) by the voice recognition engine, and also determines a process to be executed on the basis of the result of the voice recognition process.

Note that in a case where the control unit 18 is connected to a cloud 60 via the Internet or the like and a voice recognition engine exists in the cloud 60, the voice recognition engine can be used to perform the voice recognition process.

Further, when the control unit 18 inputs the speech direction information Sd from the voice signal processing unit 17 accompanying detection of a speech, the control unit 18 calculates a rotation angle of the servo motor 21 necessary for directing the front of the signal processing device 1 in the speech direction, and outputs information indicating the rotation angle to the motor drive unit 20 as rotation angle information.

The motor drive unit 20 includes a driver circuit or the like for driving the servo motor 21, and drives the servo motor 21 on the basis of the rotation angle information input from the control unit 18.

Moreover, the control unit 18 controls sound output by the speaker 16. Specifically, the control unit 18 outputs a voice signal to the voice drive unit 22 including a driver circuit (including a D-A converter, an amplifier, and the like) and the like for driving the speaker 16, so as to cause the speaker 16 to execute voice output according to the voice signal.

Note that hereinafter, the voice signal output by the control unit 18 to the voice drive unit 22 in this manner will be referred to as an "output voice signal Ss".

Figure 4:
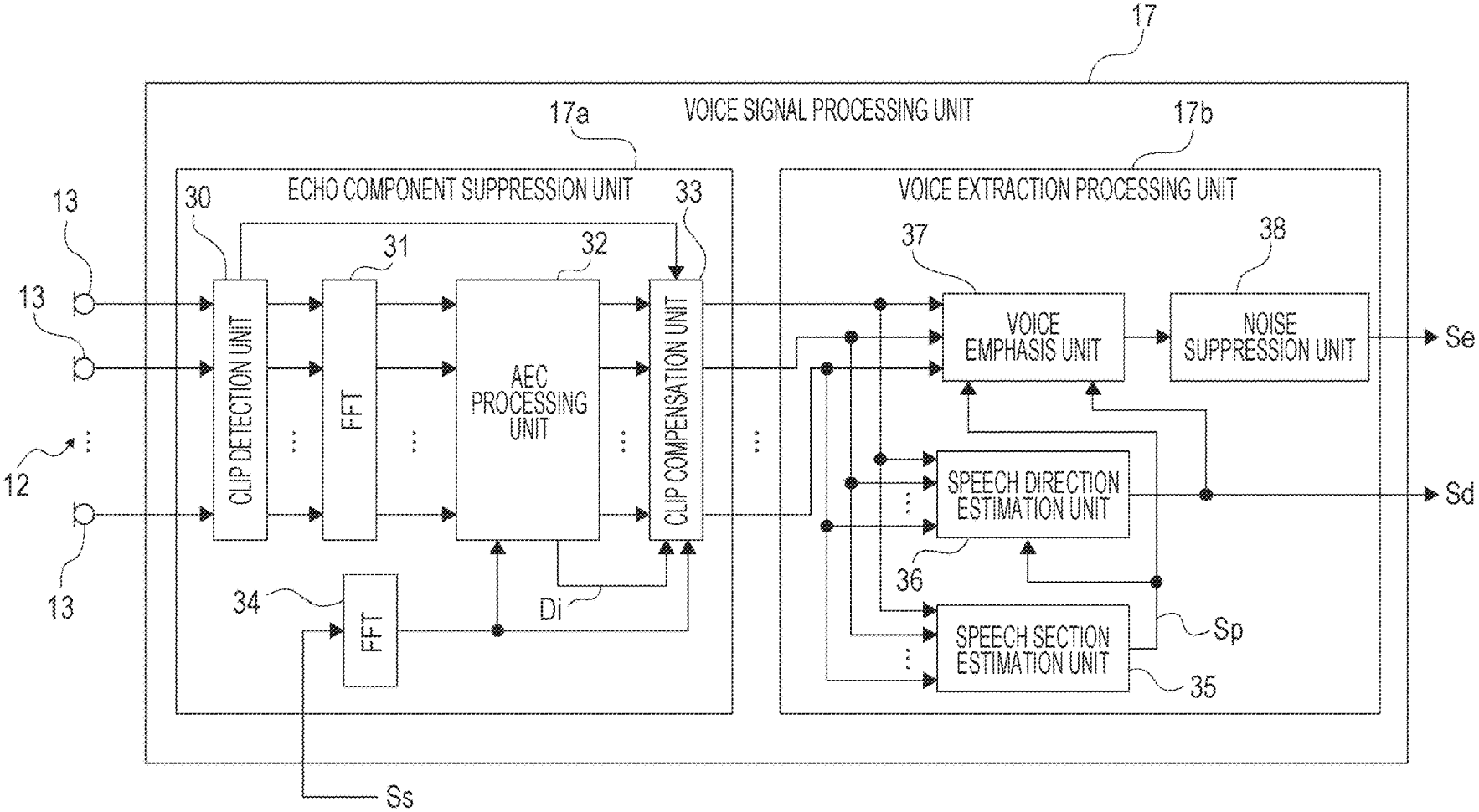
FIG. 4 is a block diagram illustrating an internal configuration example of a voice signal processing unit included in the signal processing device as the embodiment.

FIG. 4 is a block diagram illustrating an internal configuration example of the voice signal processing unit 17.

As illustrated, the voice signal processing unit 17 includes the echo component suppression unit 17*a* and the voice extraction processing unit 17*b* illustrated in FIG. 3, and the echo component suppression unit 17*a* includes a clip detection unit 30, a fast Fourier transformation (FFT) processing unit 31, an acoustic echo cancellation (AEC) processing unit 32, a clip compensation unit 33, and an FFT processing unit 34, and the voice extraction processing unit 17*b* includes a speech section estimation unit 35, a speech direction estimation unit 36, a voice emphasis unit 37, and a noise suppression unit 38.

In the echo component suppression unit 17*a*, the clip detection unit 30 performs clip detection on the signal from each microphone 13.

Figure 5:
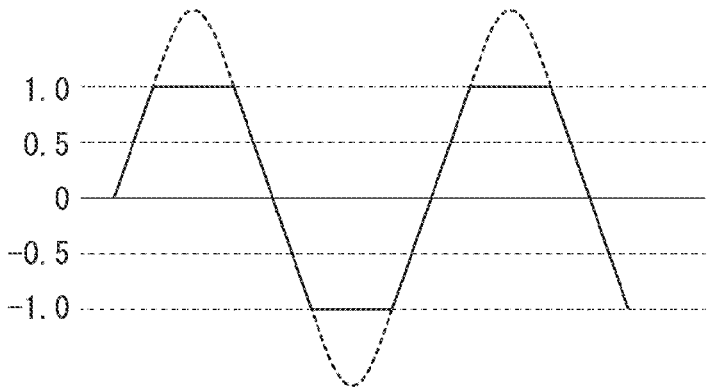
FIG. 5 is a diagram illustrating an image of a clip.

FIG. 5 illustrates an image of a clip. The clip means a phenomenon in which quantized data sticks to the maximum value during A-D conversion.

In response to detection of the clip, the clip detection unit 30 outputs information indicating the channel of the microphone 13 in which the clip is detected to the clip compensation unit 33.

In the echo component suppression unit 17*a*, the signal from each microphone 13 is input to the FFT processing unit 31 via the clip detection unit 30. The FFT processing unit 31 performs orthogonal transformation by FFT on the signal from each microphone 13 input as a time signal to convert the signal into a frequency signal.

Further, the FFT processing unit 34 performs orthogonal transformation by FFT on the output voice signal Ss input as a time signal to convert the signal into a frequency signal.

Here, the orthogonal transformation is not limited to the FFT, and for example, other techniques such as discrete cosine transformation (DCT) can also be employed.

To the AEC processing unit 32, the signals from the respective microphones 13 converted into frequency signals respectively by the FFT processing unit 31 and the FFT processing unit 34 and the output voice signal Ss are input.

The AEC processing unit 32 performs processing of canceling the echo component included in the signal from each microphone 13 on the basis of the input output voice signal Ss. That is, the voice output from the speaker 16 may be delayed by a predetermined time, and may be picked up by the microphone array 12 as an echo mixed with other voices. The AEC processing unit 32 uses the output voice signal Ss as a reference signal and performs processing so as to cancel the echo component from the signal of each microphone 13.

Further, the AEC processing unit 32 of this example performs a process related to double talk evaluation as described later, which will be described again.

The clip compensation unit 33 performs, for the signal of each microphone 13 after the echo cancellation process by the AEC processing unit 32, clip compensation based on a detection result by the clip detection unit 30 and the output voice signal Ss as a frequency signal input via the FFT processing unit 34.

In the present example, to the clip compensation unit 33, a double talk evaluation value Di generated by the AEC processing unit 32 performing the evaluation related to a double talk is input, and the clip compensation unit 33 performs clip compensation on the basis of the double talk evaluation value Di, which will be explained again.

In the voice extraction processing unit 17*b*, the signal from each microphone 13 via the clip compensation unit 33 is input to each of the speech section estimation unit 35, the speech direction estimation unit 36, and the voice emphasis unit 37.

The speech section estimation unit 35 performs a process of estimating a speech section (a section of a speech in the time direction) on the basis of the input signal from each microphone 13, and outputs the speech section information Sp that is information indicating the speech section to the speech direction estimation unit 36 and the voice emphasis unit 37.

Note that various methods, for example, methods using artificial intelligence (AI) technology (such as deep learning) and the like are conceivable as a specific method for estimating the speech section, and because these methods are not directly related to the present technology, a description of specific processing is omitted.

The speech direction estimation unit 36 estimates the speech direction on the basis of the signal from each microphone 13 and the speech section information Sp. The speech direction estimation unit 36 outputs information indicating the estimated speech direction as the speech direction information Sd.

Note that as a method of estimating the speech direction, various methods such as an estimation method on the basis of Multiple Signal Classification (MUSIC) method, specifically, MUSIC method using generalized eigenvalue decomposition can be mentioned, for example. However, the method for estimating the speech direction is not directly related to the present technology, and a description of a specific process will be omitted.

The voice emphasis unit 37 emphasizes a signal component corresponding to a target sound (speech sound here) among signal components included in the signal from each microphone 13 on the basis of the speech direction information Sd output by the speech direction estimation unit 36 and the speech section information Sp output by the speech section estimation unit 35. Specifically, a process of emphasizing the component of a sound source existing in the speech direction is performed by beam forming.

The noise suppression unit 38 suppresses a noise component (mainly a stationary noise component) included in the output signal from the voice emphasis unit 37.

The output signal from the noise suppression unit 38 is output from the voice extraction processing unit 17*b* as the extracted voice signal Se described above.

<3. Operation of Signal Processing Device>

Next, an operation of the signal processing device 1 will be described with reference to a flowchart in FIG. 6.

Figure 6:
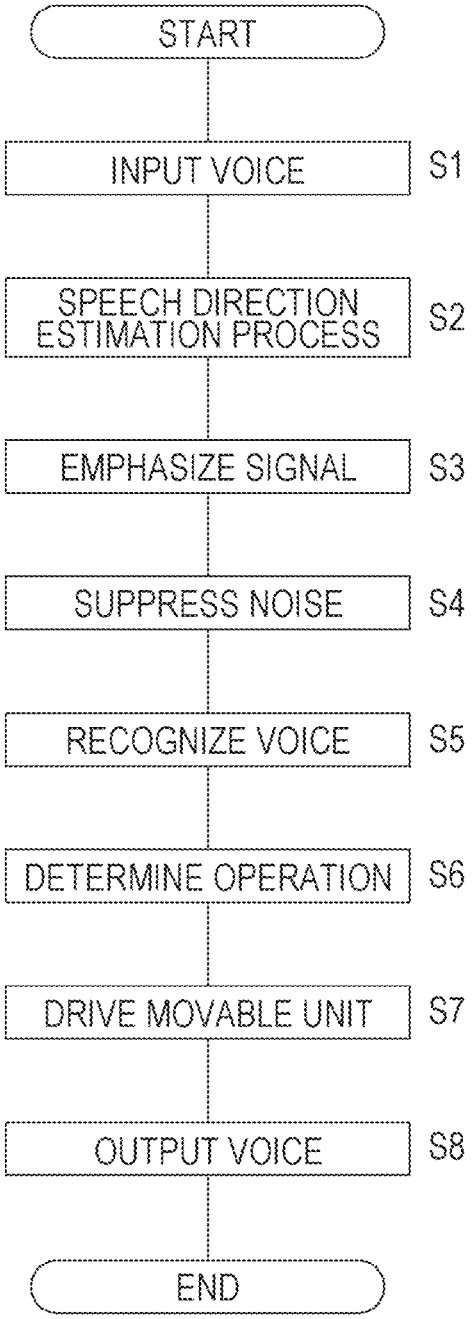
FIG. 6 is a flowchart for explaining an operation of the signal processing device as the embodiment.

Note that in FIG. 6, operations related to echo cancellation by the AEC processing unit 32 and clip compensation by the clip compensation unit 33 are omitted.

In FIG. 6, first, in step S1, the microphone array 12 inputs a voice. That is, a voice generated by a speaking person is input.

In step S2, the speech direction estimation unit 36 executes a speech direction estimation process.

In step S3, the voice emphasis unit 37 emphasizes a signal. That is, a voice component in a direction estimated as the speech direction is emphasized.

Moreover, in step S4, the noise suppression unit 38 suppresses the noise component and improves the signal-to-noise ratio (SNR).

In step S5, the control unit 18 (or an external voice recognition engine existing in the cloud 60) performs a process of recognizing a voice. That is, the process of recognizing a voice is performed on the basis of the extracted voice signal Se input from the voice signal processing unit 17. Note that the recognition result is converted into a text as necessary.

In step S6, the control unit 18 determines an operation. That is, an operation corresponding to content of the recognized voice is determined. Then, in step S7, the control unit 18 controls the motor drive unit 20 to drive the movable unit 14 by the servo motor 21.

Moreover, in step S8, the control unit 18 causes the voice drive unit 22 to output the voice from the speaker 16.

Thus, for example, when a greeting such as "hi" is recognized from the speaking person, the movable unit 14 is rotated in the direction of the speaking person, and a greeting such as "hi, how are you?" is sent to the speaking person from the speaker 16.

<4. Echo Cancellation Method in Embodiment>

Here, prior to description of clip compensation as an embodiment, first, an echo cancellation method that is assumed in the embodiment will be described.

A basic concept of an echo cancellation process will be described with reference to FIG. 7.

First, an output signal (output voice signal Ss) from the speaker 16 in a certain time frame n is referred to as a reference signal x(n). The reference signal x(n) is output from the speaker 16 and then input to the microphone 13 through the space. At this time, the signal (sound collection signal) obtained by the microphone 13 is referred to as a microphone input signal d(n).

A spatial transfer characteristic h until an output sound from the speaker 16 reaches the microphone 13 is unknown, and in the echo cancellation process, this unknown spatial transfer characteristic h is estimated, and the reference signal x(n) considering the estimated spatial transfer characteristic is subtracted from the microphone input signal d(n). The estimated spatial transfer characteristic will be referred to as an estimated transfer characteristic w(n) below.

The output sound of the speaker 16 that reaches the microphone 13 includes a component having a certain time delay, such as a sound that directly arrives is reflected on a wall or the like and returns, and thus when a target delay time in the past is represented by a tap length L, the microphone input signal d(n) and the estimated transfer characteristic w(n) can be represented as the following [Formula 1] and [Formula 2].

[Mathematical Formula 1]

$$x(n)=[x_n,x_{n-1},\ldots,x_{n-L+1}]^T \quad \text{[Formula 1]}$$

$$w(n)=[w_n,w_{n-1},\ldots,w_{n-L+1}]^T \quad \text{[Formula 2]}$$

In [Formula 1], T represents transposition.

In practice, the number of frequency bins N that has been subjected to fast Fourier transformation for the time frame n is estimated. In a case where a general least mean square (LMS) method is used, an echo cancellation process at a frequency k (k=1 to N) is performed with the following [Formula 3] and [Formula 4].

[Mathematical Formula 2]

$$e(k,n)=d(k,n)-w(k,n)^H x(k,n) \quad \text{[Formula 3]}$$

$$w(k,n+1)=w(k,n)+\mu e(k,n)^* x(k,n) \quad \text{[Formula 4]}$$

H represents a Hermitian transposition and represents a complex conjugate. μ is a step size that determines the learning speed, and normally a value between $0<\mu\leq 2$ is selected.

As illustrated in [Formula 3], an error signal e(k,n) is obtained by subtracting an estimated sneak signal obtained as a reference signal (x) for L tap lengths convolving an estimated transfer characteristic w(k,n) from a microphone input signal d(k,n).

Figure 7:
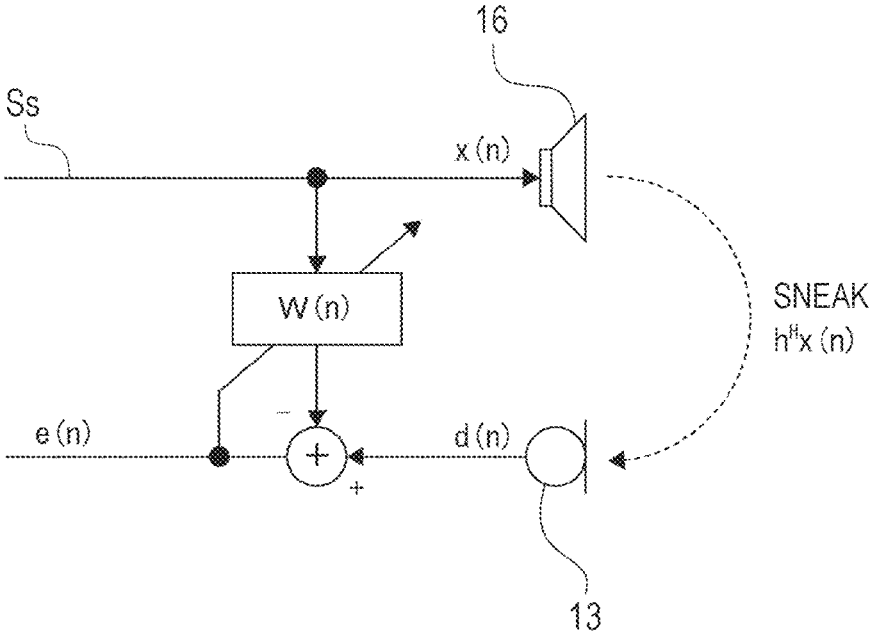
FIG. 7 is a diagram for explaining a basic concept of an echo cancellation process.

As can be seen from FIG. 7, this error signal e(k,n) corresponds to an output signal of the echo cancellation process.

In the LMS method, w is sequentially updated so that the average power of the error signal e(k,n) is minimized.

Note that in addition to the LMS method, there are methods such as normalized LMS (NLMS) obtained by normalizing an update-type reference signal, affine projection algorithm (APA), recursive least square (RLS), and the like. In any of the methods, the reference signal x is used to learn the estimated transfer characteristic.

Figure 8:
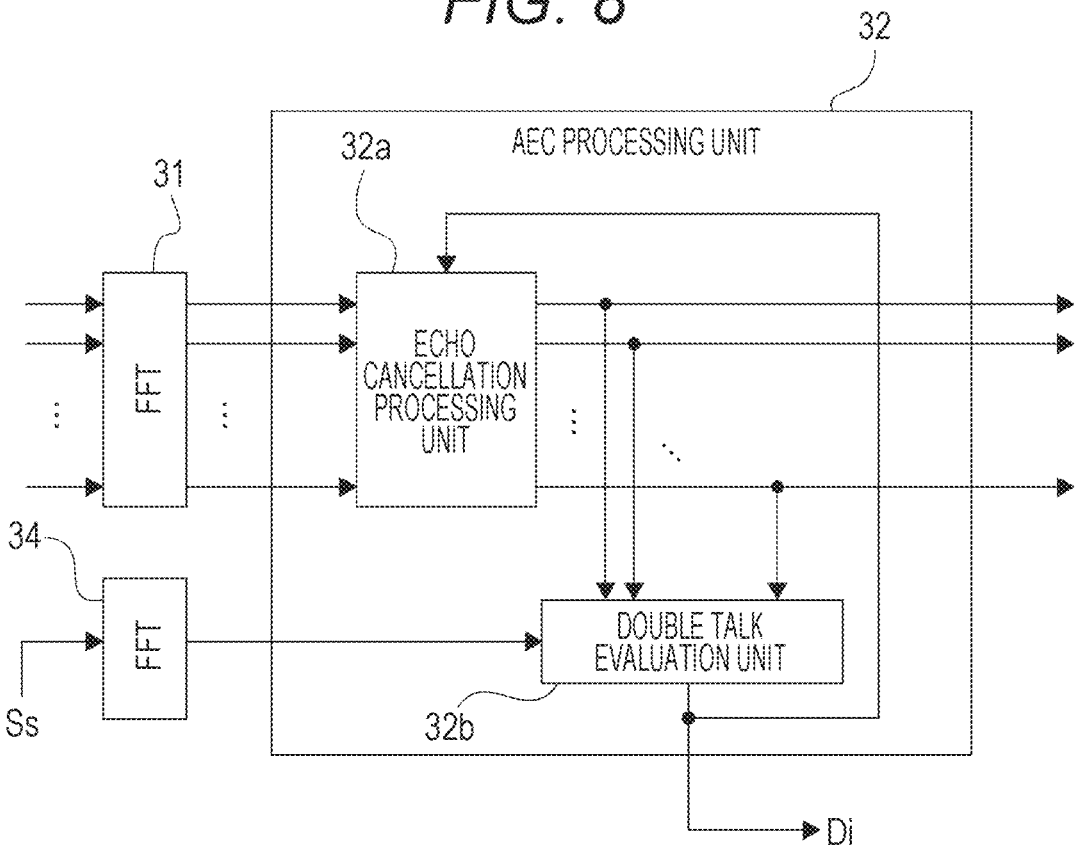
FIG. 8 is a diagram illustrating an internal configuration example of an AEC processing unit included in the signal processing device as the embodiment.

Here, the AEC processing unit 32 is usually configured to reduce the learning speed during the double talk by a configuration as illustrated in FIG. 8 in order to avoid erroneous learning during a double talk.

Figure 9:
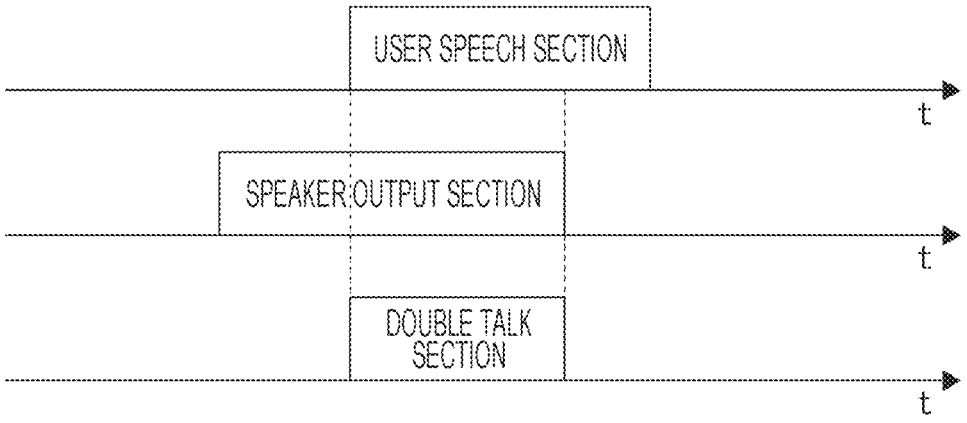
FIG. 9 is an explanatory diagram of a double talk.

The double talk mentioned here means that a user speech and a speaker output are temporally overlapped, as illustrated in FIG. 9.

In FIG. 8, the AEC processing unit 32 includes an echo cancellation processing unit 32*a* and a double talk evaluation unit 32*b*.

Here, in the following description, the notations of time n and frequency bin number k will be omitted unless time information and frequency information are handled in the description.

The double talk evaluation unit 32*b* calculates a double talk evaluation value Di representing certainty of whether or not it is during the double talk on the basis of the output voice signal Ss by a frequency signal input via the FFT processing unit 34, that is, the reference signal x, and the signal (error signal e) of each microphone 13 that has undergone the echo cancellation process by the echo cancellation processing unit 32*a*.

The echo cancellation processing unit 32*a* calculates the error signal e according to [Formula 3] described above on the basis of the signal from each microphone 13 input via the FFT processing unit 31, that is, the microphone input signal d, and the output voice signal Ss input via the FFT processing unit 34 (that is, the reference signal x).

Further, the echo cancellation processing unit 32*a* sequentially learns the estimated transfer characteristic w according to [Formula 6] described later, on the basis of the error signal e, the reference signal x, and the double talk evaluation value Di input from the double talk evaluation unit 32*b*.

Here, various methods for evaluating double talk have been proposed, but as a typical method, there is a method using fluctuations of average power of the reference signal x and instantaneous signal power after an echo cancellation process (Wiener type double talk determination unit). In this method, the double talk evaluation value Di becomes a value close to "1" during normal learning and behaves so as to approach "0" during the double talk.

Specifically, in this example, the double talk evaluation value Di is calculated by the following [Formula 5].

[Mathematical Formula 3]

$$D_i = \frac{\overline{P_{ref}}}{\overline{P_{ref}} + \beta e_i e_i^H} \quad \text{[Formula 5]}$$

In [Formula 5], "Pref^−" (note that "^−" means that "−" is written above "Pref") is "Pref^−=E[xxH]", and means the average power of the reference signal x (however, E[□] represents an expected value). Further, "β" is a sensitivity adjustment constant.

During the double talk, the error signal e increases due to the influence of the speech component. Therefore, according to [Formula 5], the double talk evaluation value Di becomes small during the double talk. Conversely, if it is during a non-double talk and the error signal e is small, the double talk evaluation value Di becomes large.

The echo cancellation processing unit 32*a* learns the estimated transfer characteristic w according to following [Formula 6] on the basis of the double talk evaluation value Di as described above.

[Mathematical Formula 4]

$$w_i(n+1)=w_i(n)+\mu D_i e_i(n)*x(n) \quad \text{[Formula 6]}$$

Thus, during the double talk in which the double talk evaluation value Di becomes small, the learning speed by an adaptive filter is reduced, and erroneous learning during the double talk is suppressed.

5. Clip Compensation Method as Embodiment

Next, a clip compensation method as an embodiment will be described.

First, as a premise, when a signal clipped by a time signal is decomposed into frequency components by Fourier transformation, a signal that originally does not exist during transmission in the space appears as noise at each frequency (clipping noise). This clipping noise cannot be removed by a linear echo canceller as used in this example, and an erasure residue in large volume occurs only at the moment of clipping. This erasure residue component is generated over a wide area and becomes a factor that deteriorates accuracy of voice recognition in a subsequent stage.

In the present embodiment, clip compensation is performed in consideration of such a premise.

In the present embodiment, the clip compensation unit 33 (see FIG. 4) determines whether or not there is a channel in which a clip has occurred (a channel of the microphone 13) on the basis of the detection result of the clip detection unit 30. Then, if there is a channel in which a clip has occurred, a clip compensation process described below is applied to the signal after the echo cancellation process for this channel.

In the present embodiment, the clip compensation process is performed on the basis of the signal of the microphone 13 that is not clipped. Specifically, it is performed by suppressing the signal of the clipped microphone 13 on the basis of the average power ratio between the signal of the non-clipped microphone 13 and the signal of the clipped microphone 13.

In the following example, as the average power ratio described above, the ratio to the minimum average power among non-clipped channels is used.

In the present embodiment, the clip compensation process is basically performed by the method represented by the following [Formula 7].

Here, in the following, a signal after clip compensation is expressed as "$e_i$^~" (note that "^~" means that "~" is written above "$e_i$").

[Mathematical Formula 5]

$$\tilde{e}_i = e_{Min} e_{Min}^H \frac{P_i}{\overline{P_{Min}}} \frac{1}{e_i e_i^H} e_i \quad \text{[Formula 7]}$$

In [Formula 7], "$e_i$" represents an instantaneous signal after the echo cancellation process of an i channel (clipped channel), and "$e_{Min}$" represents an instantaneous signal after the echo cancellation process of the channel with the minimum average power among the non-clipped channels.

Further, "$P_i$^−" ("^−" means that "−" is written above "$P_i$") is "$P_i$^−=E[$e_i e_i^H$]", and represents the average power of the signal after the echo cancellation process for i channel, and "$P_{Min}$^−" ("^−" means that "−" is written above "$P_{Min}$") means the minimum average power among the non-clipped channels.

The average power here means the average power in a section where a speaker output is present and no clipping is present.

The basic concept of the clip compensation according to [Formula 7] can be explained as follows.

That is, only phase information is extracted from the signal of the clipped channel (i), and the signal power is replaced with the instantaneous power of the non-clipped channel (in this example, the channel with the minimum average power). However, if left as it is, the signal power after the echo cancellation process that has to be output in a case where no clipping has occurred will not be achieved, and thus the replaced signal power is corrected using a signal power ratio between channels that has been sequentially obtained.

In other words, the clipping compensation according to [Formula 7] can be represented as to suppress a non-linear component that is an erasure residue after the echo cancellation process, and perform gain correction on the signal of the clipped channel to an estimated suppression level when it is not clipped, on the basis of the microphone input signal information of the non-clipped channel.

Here, the fact that only the phase information is extracted from the signal of the clipped channel as described above is expressed by the terms "$1/e_i e_i^H$" and "$e_i$" in [Formula 7].

Further, the point that the signal power is replaced with the instantaneous power of the non-clipped channel is expressed by the term "$e_{Min} e^H_{Min}$" in [Formula 7].

Moreover, the point that the replaced signal power is corrected using the signal power ratio between channels that has been sequentially obtained is expressed by the term "$P_i^{\wedge-}/P_{Min}^{\wedge-}$" in [Formula 7].

Note that the reason for a difference to occur in the signal power ratio between channels is that a difference occurs between signals of respective channels due to a directivity characteristic of the speaker 16, a transmission path in the space, microphone sensitivity variation, and stationary noise having directivity, or the like.

In the clip compensation of the present embodiment, regarding the clipped channel, the waveform itself of the signal is not replaced with the waveform of another channel, and the phase information is left. By doing so, the phase relationship among the microphones 13 is prevented from being destroyed due to the clip compensation. Since the phase relationship among the microphones 13 is important in the speech direction estimation process, the present method can prevent speech direction estimation accuracy from being deteriorated due to the clip compensation. That is, beamforming by the voice emphasis unit 37 is less likely to fail, and the voice recognition accuracy by the voice recognition engine in the subsequent stage can be improved.

Here, average powers as "$P_i^{\wedge-}$" and "$P_{Min}^{\wedge-}$" are sequentially calculated by the clip compensation unit 33 in a section in which no clip has occurred and a speaker output is present. At this time, the clip compensation unit 33 identifies the section in which no clip has occurred and a speaker output is present on the basis of the detection result by the clip detection unit 30, and the output voice signal Ss (reference signal x) input through the FFT processing unit 34.

As the clip compensation, the compensation by [Formula 7] can always be performed at least for a user speech section, but in this example, dividing into cases as illustrated in next FIG. 10 is performed, and a process related to the clip compensation is selectively executed corresponding to each of the cases.

Specifically, in a case where both the speaker output and the user speech are "present", which is represented as "Case 1" in the diagram, the suppression amount in the clip compensation is adjusted according to the user speech while performing the clip compensation.

Further, in a case where the speaker output is "present" and the user speech is "none" as "Case 2", the clip compensation is performed.

In a case where the speaker output is "none" and the user speech is "present" as "Case 3", a process corresponding to the voice recognition engine is performed.

In a case where both the speaker output and the user speech are "none" as "case 4", the clip compensation is not performed. In this case, the signal after the echo cancellation process is discarded before voice recognition.

Note that a cause of clipping in Case 1 can be presumed to be a double talk as illustrated in the diagram. Further, it can be estimated that the causes of clipping in Case 2, Case 3, and Case 4 are sneaking into speaker, user speech, and noise, respectively.

First, the clip compensation that is performed in the case of Case 1 and that involves the suppression amount adjustment according to the user speech level will be described.

In a case where the user speech level is high, information of the target sound (speech sound) tends to be mostly included also in a superposition section of clipping noise, and thus the signal suppression amount in the clip compensation is preferred to be reduced for the voice recognition process in the subsequent stage. On the contrary, in a case where the user speech level is low, the speech component tends to be buried in large clipping noise, and thus increasing the signal suppression amount in the clip compensation is preferred for the voice recognition process in the subsequent stage.

Accordingly, in Case 1, the clip compensation involving adjustment of the suppression amount according to the user speech level is performed by the following [Formula 8].

[Mathematical Formula 6]

$$\bar{e}_i = \alpha_{dt} e_{Min} e_{Min}^H \frac{\overline{P}_i}{\overline{P}_{Min}} \frac{1}{e_i e_i^H} e_i \qquad \text{[Formula 8]}$$

In [Formula 8], "$\alpha_{dt}$" is a suppression amount correction coefficient, the signal suppression amount is maximum when $\alpha_{dt}$ is "1", and the signal suppression amount is reduced as $\alpha_{dt}$ becomes larger than "1".

In Case 1, the value of the suppression amount correction coefficient $\alpha_{dt}$ is adjusted according to the speech level.

The following [Formula 9] illustrates an example of an adjustment formula of the suppression amount correction coefficient $\alpha_{dt}$. [Formula 9] exemplifies an adjustment formula using a sigmoid function, where "a" is a sigmoid function inclination constant and "c" is a sigmoid function center correction constant.

[Mathematical Formula 7]

$$\alpha_{dt} = \frac{\text{Max}}{1 + \exp^{-a[\overline{P_{dti}} - c]}} \qquad \text{[Formula 9]}$$

In [Formula 9], "$P_{dti}^{\wedge-}$" ("$^{\wedge-}$" means that "$^{-}$" is written above "$P_{dti}$") is "$P_{dti}^{\wedge-}=E[e_i e_i^H]$" and represents the average power of the signal after the echo cancellation processing of an i channel during the double talk and in a non-clipped section. Such "$P_{dti}^{\wedge-}$" can be treated as an estimated value of the user speech level.

"Max" is a value represented by the following [Formula 10] and [Formula 11], and means the maximum value of the suppression amount correction coefficient $\alpha_{dt}$. That is, it is a value that makes "$e_i^{\wedge\sim}$" *calculated by* [*Formula* 8] the same power as "$e_i$" input from the AEC processing unit 32, in other words, a value that cancels the clip compensation (or that brings the signal suppression amount into a maximally lowered state).

[Mathematical Formula 8]

$$\text{Max} = \frac{1}{g'} \qquad \text{[Formula 10]}$$

$$g' = e_{Min} e_{Min}^H \frac{\overline{P}_i}{\overline{P}_{Min}} \frac{1}{e_i e_i^H} \qquad \text{[Formula 11]}$$

FIG. 11 illustrates a behavior of the sigmoid function according to [Formula 9].

According to the adjustment formula represented by [Formula 9], the value of the suppression amount correction coefficient $\alpha_{dt}$ changes from "1" to "Max" accompanying that the magnitude of "$P_{dti}^{\wedge-}$" as a user speech level estimated value changes. Specifically, in a case where the speech level estimated value "$P_{dti}^{\wedge-}$" is large, the value of the suppression amount correction coefficient $\alpha_{dt}$ approaches "Max", thereby decreasing the signal suppression amount according to [Formula 8]. On the contrary, in a case where the speech level estimated value "$P_{dti}^{\wedge -}$" is small, the value of the suppression amount correction coefficient $\alpha_{dt}$ approaches "1", thereby increasing the signal suppression amount according to [Formula 8].

Note that as described above, the clip compensation unit 33 estimates the speech level of the user on the basis of the average power during the double talk in the non-clipped section of the signal of the clipped microphone 13 (the signal after the echo cancellation process).

Therefore, the speech level of the signal of the clipped microphone 13 can be appropriately obtained at a time when clipping occurs.

Here, in the clip compensation unit 33, it is necessary to determine whether or not it is during the double talk in order to sequentially calculate "$P_{dti}^{\wedge -}$" as the user speech level estimated value. The determination as to whether or not it is during the double talk is performed on the basis of the output voice signal Ss (reference signal x) input via the FFT processing unit 34, the double talk evaluation value Di, and a double talk determination threshold $\gamma$.

Specifically, presence or absence of the speaker output is determined on the basis of the output voice signal Ss, and as a result, if it is determined that a speaker output is present and it is determined that the double talk evaluation value Di is equal to or less than the double talk determination threshold $\gamma$, a determination result that it is during the double talk is obtained.

The description is returned to FIG. 10.

As the clip compensation for Case 2, clip compensation is performed by the method represented by [Formula 7].

Further, as the process corresponding to the voice recognition engine in Case 3, clip compensation is performed in which the value of the suppression amount correction coefficient $\alpha_{dt}$ in [Formula 8] is made to correspond to characteristics of the voice recognition engine (characteristics of the voice recognition process). As the value of the suppression amount correction coefficient $\alpha_{dt}$ at this time, for example, a fixed value that is predetermined according to the voice recognition engine in the control unit 18 (or the cloud 60) is used.

Note that Case 3 is not limited to executing the process corresponding to the voice recognition engine as described above, and the clip compensation may be omitted as illustrated in parentheses in FIG. 10.

In a case where a user speech is present and no speaker output is present as in Case 3, that is, a case where the cause of the clip is estimated to be the user speech, it is empirically known that not suppressing the signal can result in a more favorable voice recognition result in the subsequent stage. In such a case, it is possible to improve the voice recognition accuracy by not performing the clip compensation.

It has been described above that the clip compensation unit 33 selectively executes the process related to the clip compensation corresponding to dividing into cases depending on presence or absence of the speaker output and presence or absence of the user speech. However, at this time, determination of the presence or absence of the user speech is performed on the basis of the double talk evaluation value Di. Specifically, the clip compensation unit 33 obtains, for example, a determination result that a user speech is present if the double talk evaluation value Di is equal to or smaller than a predetermined value, or a determination result that no user speech is present if the double talk evaluation value Di is larger than the predetermined value.

Note that as described in [Formula 5], the double talk evaluation value Di is an evaluation value that increases during the double talk in which a user speech is present.

Here, a difference between the clip compensation method as the embodiment represented by [Formula 7] or [Formula 8] and the conventional technique will be described with reference to FIGS. 12 and 13.

Figure 12:
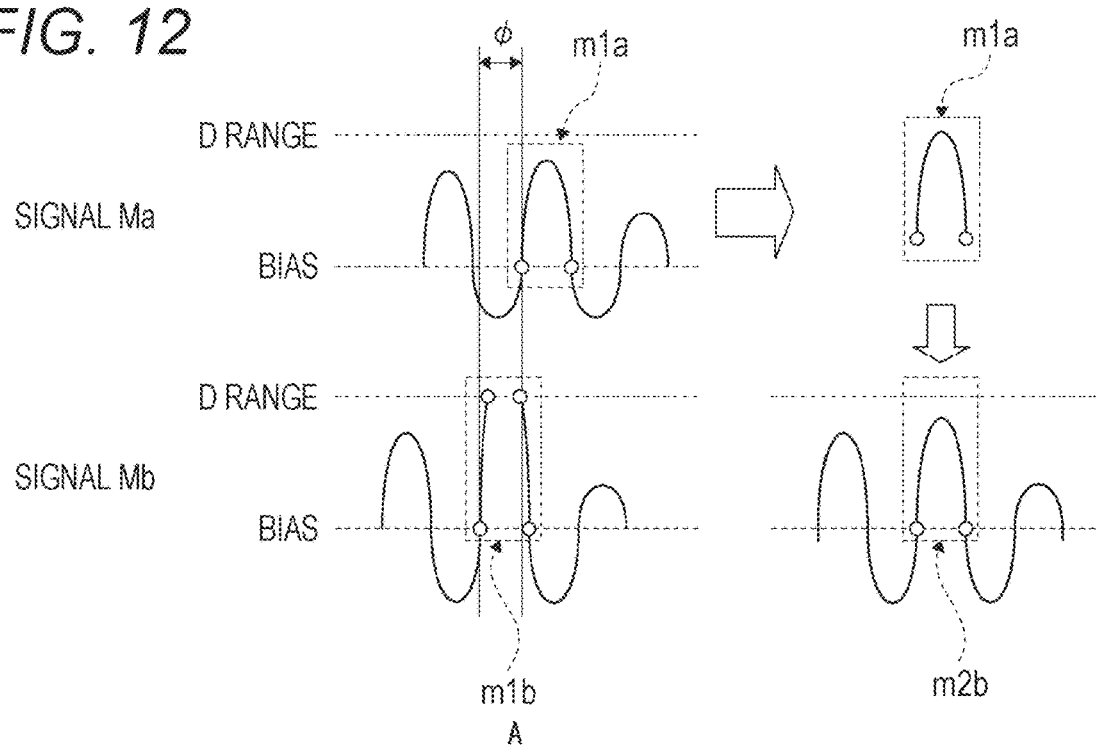
FIG. 12 is a diagram schematically representing a clip compensation method in a conventional technique.
Figure 13:
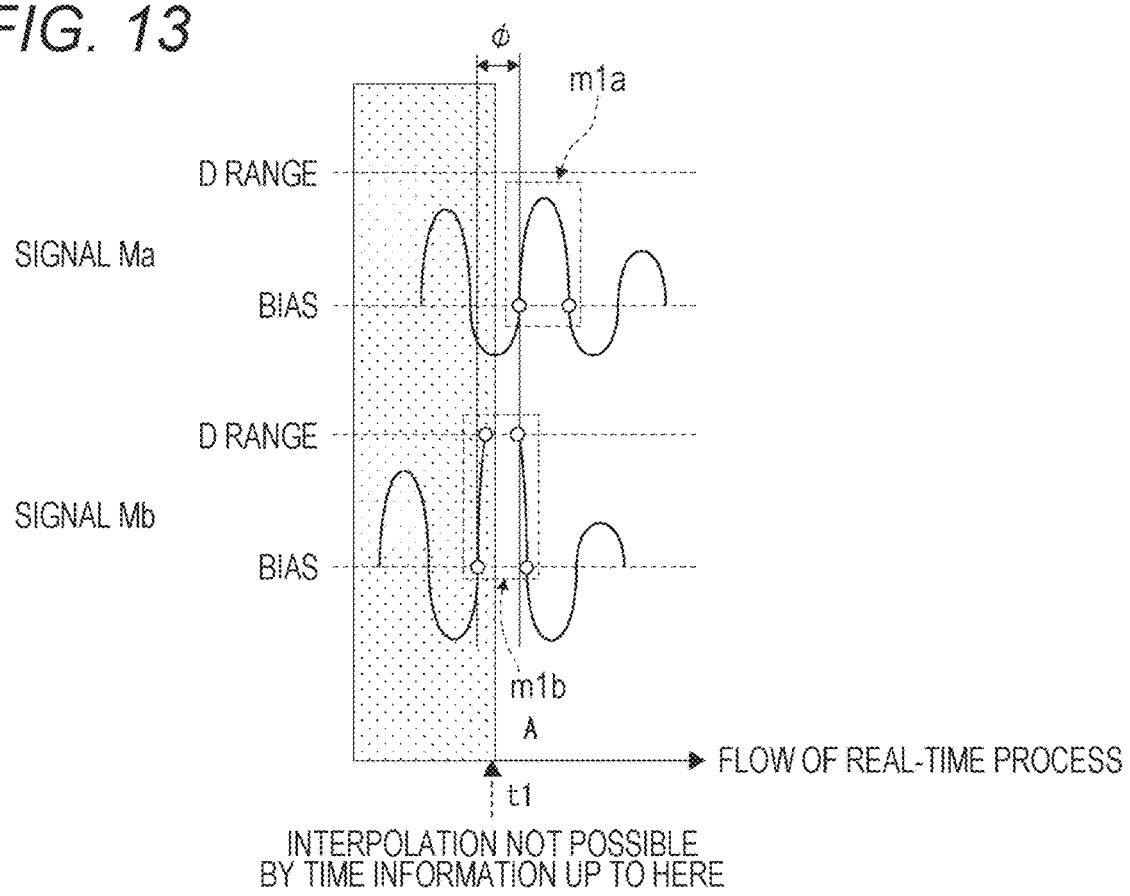
FIG. 13 is an explanatory diagram of a problem in the conventional technique.

FIG. 12 schematically represents the clip compensation method described in Patent Document 1 described above as a conventional technique.

In the method described in Patent Document 1, a signal (division signal m1*b*) between zero cross points including a clip portion of a clipped signal (voice signal Mb) is replaced with a signal (division signal m1*a*) between corresponding zero cross points in a non-clipped signal (voice signal Ma).

An example of FIG. 12 illustrates an example in which the division signal m1*a*, which corresponds to the clip portion, in the non-clipped voice signal Ma arrives later in time than the clip portion, but in this case, according to the method of Patent Document 1, the clip compensation cannot be performed in real time at a clip timing illustrated as time t1 in FIG. 13.

On the other hand, according to the clip compensation method as the embodiment represented by [Formula 7] or [Formula 8], it is not necessary to wait for the arrival of the waveform section corresponding to the clip portion in the non-clipped signal, and the clip compensation can be performed in real time at the timing of occurrence of the clip.

<6. Processing Procedure>

A specific processing procedure to be executed in order to achieve the clip compensation method as the embodiment described above will be described with reference to a flowchart in FIG. 14.

Figure 14:
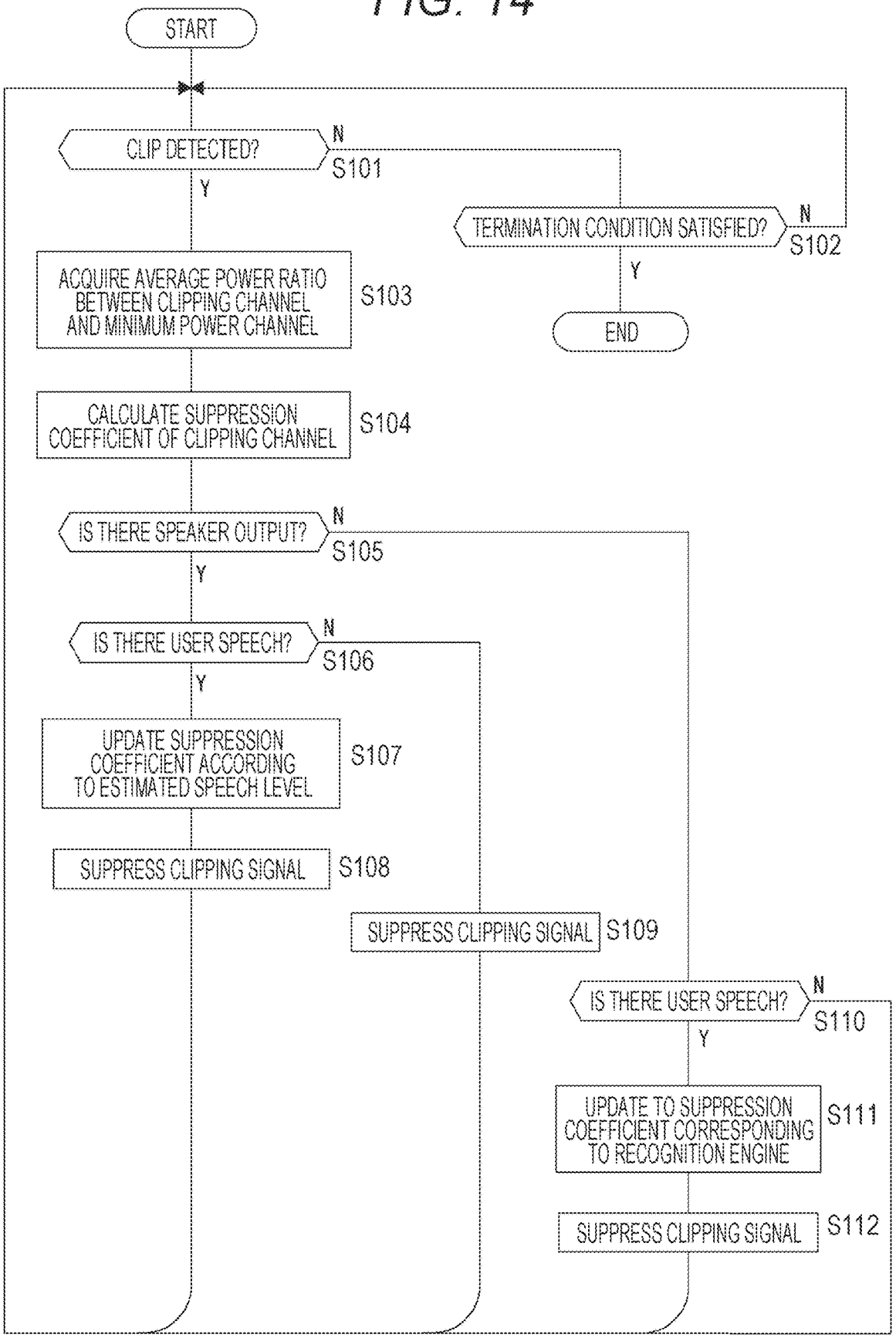
FIG. 14 is a flowchart illustrating a specific processing procedure to be executed to implement the clip compensation method as the embodiment.

The clip compensation unit 33 repeatedly executes a process illustrated in FIG. 14 for every time frame.

Note that the clip compensation unit 33 executes, apart from the process illustrated in FIG. 14, a process of sequentially calculating "$P_{dti}^{\wedge -}$" as the average power of every channel of the microphone 13 (the average power after the echo cancellation process in a section where a speaker output is present and no clipping has occurred) and as the user speech level estimated value.

First, the clip compensation unit 33 determines in step S101 whether or not a clip is detected. That is, presence or absence of a channel in which a clip has occurred is determined on the basis of the detection result of the clip detection unit 30.

If it is determined that no clip is detected, the clip compensation unit 33 determines in step S102 whether or not a termination condition is satisfied. Note that the termination condition here is a condition predetermined as a processing termination condition, such as power-off of the signal processing device 1, for example.

If the termination condition is not satisfied, the clip compensation unit 33 returns to step S101, or if the termination condition is satisfied, the series of processes illustrated in FIG. 14 is terminated.

If it is determined in step S101 that a clip has been detected, the clip compensation unit 33 proceeds to step S103 and acquires the average power ratio between a clipping channel and a minimum power channel. That is, out of the average powers of the respective channels calculated sequentially, the ratio ("$P_i^{\wedge -}/P_{Min}^{\wedge -}$") of the average power of the clipped channel and the average power of the channel with the minimum average power is acquired by calculation.

In subsequent step S104, the clip compensation unit 33 calculates a suppression coefficient of the clipping channel. Here, the suppression coefficient means a portion that excludes the terms "$e_{Min}e^{H}_{Min}$" and "$e_i$" on the right side of [Formula 7].

Then, in step S105, the clip compensation unit 33 determines whether or not a speaker output is present. This determination process corresponds to determining which of a set of Case 1 and Case 2 and a set of Case 3 and Case 4 illustrated in FIG. 10 is applicable.

If it is determined that a speaker output is present, the clip compensation unit 33 determines in step S106 whether or not a user speech is present.

If it is determined in step S106 that a user speech is present (that is, corresponding to Case 1), the clip compensation unit 33 proceeds to step S107 and updates the suppression coefficient according to the estimated speech level. That is, first, the suppression amount correction coefficient $\alpha_{dt}$ is calculated with the above [Formula 9] on the basis of the speech level estimated value "$P_{dti}^{\wedge-}$". Then, the suppression coefficient is updated by multiplying the suppression coefficient obtained in step S104 by the calculated suppression amount correction coefficient $\alpha_{dt}$.

Then, the clip compensation unit 33 executes a clipping signal suppression process of step S108, and returns to step S101. As the clipping signal suppression process in step S108, a process of calculating "$e_i^{\wedge}\sim$" with [Formula 8] is performed using the suppression coefficient updated in step S107.

Further, if it is determined in step S106 that a user speech is present (that is, corresponding to Case 2), the clip compensation unit 33 proceeds to step S109 to execute the clipping signal suppression process, and returns to step S101. As the clipping signal suppression process in step S109, a process of calculating "$e_i^{\wedge}\sim$" with [Formula 7] using the suppression coefficient obtained in step S104.

Further, if it is determined in step S105 that no speaker speech is present (Case 3 or Case 4), the clip compensation unit 33 determines in step S110 whether or not a user speech is present.

If it is determined in step S110 that a user speech is present (Case 3), the clip compensation unit 33 proceeds to step S111, and performs a process of updating to the suppression coefficient according to the recognition engine. That is, the suppression coefficient is updated by multiplying the suppression coefficient obtained in step S104 by the suppression amount correction coefficient $\alpha_{dt}$ determined according to the characteristics of the voice recognition engine.

Then, the clip compensation unit 33 performs the process of calculating "$e_i^{\wedge}\sim$" with [Formula 8] using the suppression coefficient updated in step S111 as the clipping signal suppression process of step S112, and returns to step S101.

Further, if it is determined in step S110 that no user speech is present (Case 4), the clip compensation unit 33 returns to step S101. That is, in this case, the clip compensation is not performed.

<7. Modification Example>

Here, the embodiment is not limited to the specific examples described above, and various modifications can be made without departing from the scope of the present technology.

For example, in the foregoing, the example in which the plurality of microphones 13 is arranged on the circumference has been described, but an arrangement other than the arrangement on the circumference, such as a linear arrangement, may be employed.

Further, in the embodiment, the example has been described in which the signal processing device 1 includes the servo motor 21 to be capable of changing the orientation of the speaker 16, that is, capable of changing the positions of the respective microphones 13 with respect to the speaker 16. However, in a case of employing such a configuration, for example, the clip compensation unit 33 or the control unit 18 can be configured to instruct the motor drive unit 20 to change the position of the speaker 16 in response to detection of a clip. Thus, the position of the speaker 16 can be moved to a position where wall reflection or the like is small, and the possibility of clipping to occur can be decreased and clipping noise can be reduced.

Note that the signal processing device 1 may employ a configuration in which the side of the microphones 13 is displaced instead of the speaker 16, and even in this case, effects similar to those described above can be obtained by displacing the microphones 13 in response to detection of a clip similarly to as described above.

Further, the displacement of the speaker 16 and the microphones 13 is not limited to a displacement caused by rotation. For example, the signal processing device 1 may employ a configuration including wheels and a drive unit thereof, or the like to be capable of moving by itself. In this case, the drive unit may be controlled so that the signal processing device 1 itself is moved in response to detection of a clip. Thus, also by the signal processing device 1 itself moving in this manner, it is possible to move the positions of the speaker 16 and the microphones 13 to positions where wall reflection or the like is small, and effects similar to those described above can be obtained.

Note that the configuration in which the speaker 16 and the microphones 13 are displaced according to detection of a clip as described above can be applied even in a case where the clip compensation represented by [Formula 7] or [Formula 8] is not performed.

<8. Summary of Embodiment>

As described above, a signal processing device (same 1) as the embodiment includes an echo cancellation unit (AEC processing unit 32) that performs an echo cancellation process of canceling an output signal component from a speaker (same 16) on signals from a plurality of microphones (same 13), a clip detection unit (same 30) that performs a clip detection for signals from the plurality of microphones, and a clip compensation unit (same 33) that compensates for a signal after the echo cancellation process of clipped one of the microphones on the basis of a signal of non-clipped one of the microphones.

In a case where the echo cancellation process is performed on signals from the plurality of microphones, when the clip compensation is performed on a signal before the echo cancellation process, the clip compensation is performed in a state that an output signal component of the speaker and other components including a target sound are difficult separate, and thus clip compensation accuracy tends to decrease. By performing the clip compensation on the signal after the echo cancellation process as described above, it is possible to perform the clip compensation on a signal in which the output signal component of the speaker is suppressed to some extent.

Therefore, the clip compensation accuracy can be improved.

Further, in the signal processing device as the embodiment, the clip compensation unit compensates for a signal of the clipped microphone by suppressing the signal.

By employing a compensation method of suppressing the signal of the clipped microphone, it is possible to prevent phase information of the signal of the clipped microphone from being lost by the compensation.

Therefore, it is possible to prevent the phase relationship among the respective microphones from being destroyed by the compensation.

In the configuration in which voice recognition is performed by performing speech direction estimation and beamforming (voice emphasis) in the subsequent stage of the clip compensation as in the embodiment, accuracy of speech direction estimation is improved because the phase relationship among the respective microphones is not destroyed, a target speech component can be appropriately extracted by beamforming, and voice recognition accuracy can be improved.

Moreover, in the signal processing device as the embodiment, the clip compensation unit suppresses a signal of the clipped microphone on the basis of an average power ratio between a signal of the non-clipped microphone and a signal of the clipped microphone.

Thus, power of the signal of the clipped microphone can be appropriately suppressed to power after the echo cancellation process that has to be obtained in a case where it is not clipped.

Therefore, the accuracy of the clip compensation can be improved.

Furthermore, in the signal processing device according to the embodiment, the clip compensation unit uses, as the average power ratio, an average power ratio with a signal of the microphone having a minimum average power among the signals of the non-clipped microphones is used.

The microphone with the minimum average power can be restated as the microphone in which it is most difficult for clipping to occur.

Therefore, it is possible to maximize certainty that the compensation is performed for the signal of the clipped microphone.

Further, in the signal processing device as the embodiment, the clip compensation unit adjusts a suppression amount of a signal of the clipped microphone according to a speech level in a case where a user speech is present and a speaker output is present.

In what is called a double talk section in which a user speech is present and a speaker output is present, in a case where the speech level of the user is high, the speech component is also included in a large amount even in the noise superposed section due to clipping. On the other hand, in a case where the speech level is low, the speech component tends to be buried in large clipping noise. Accordingly, in the double talk section, the suppression amount of the signal of the clipped microphone is adjusted according to the speech level.

Thus, if the speech level of the user is high, it is possible to reduce the suppression amount of the signal to prevent the speech component from being suppressed, and when the speech level of the user is low, it is possible to increase the suppression amount of the signal to suppress the clipping noise.

Therefore, when voice recognition is performed in a subsequent stage of the clip compensation as in the embodiment, the voice recognition accuracy can be improved.

Moreover, in the signal processing device as the embodiment, the clip compensation unit suppresses a signal of the clipped microphone by a suppression amount according to a characteristic of a voice recognition process in a subsequent stage in a case where a user speech is present and no speaker output is present.

The case where a user speech is present and no speaker output is present is a case where a cause of a clip is estimated to be the user speech. With the above configuration, in the case where the cause of the clip is estimated to be the user speech, for example, it is possible to perform the clip compensation with an appropriate suppression amount according to characteristics of the voice recognition process in the subsequent stage such that the voice recognition accuracy can be maintained better in a case where there is a certain degree of speech level even if clipping noise is superposed than in a case where the speech component is suppressed, or the like.

Therefore, the voice recognition accuracy can be improved.

Furthermore, in the signal processing device as the embodiment, the clip compensation unit does not perform the compensation for the clipped microphone signal in a case where a user speech is present and no speaker output is present.

In the case where the user speech is present and the speaker output is not present, that is, a case where the cause of the clip is estimated to be the user speech, it is empirically known that not suppressing the signal can result in a more favorable voice recognition result in the subsequent stage. In such a case, it is possible to improve the voice recognition accuracy by not performing the clip compensation as described above.

Further, the signal processing device as the embodiment further includes a drive unit (servo motor 21) that changes a position of at least one of the plurality of microphones or the speaker, and a control unit (clip compensation unit 33 or control unit 18) that changes the position of at least one of the plurality of microphones or the speaker by the drive unit in response to detection of a clip by the clip detection unit.

Thus, if a clip is detected, it is possible to change the positional relationship among the respective microphones and the speaker, or move the positions of the plurality of microphones or the speaker to a position where wall reflection or the like is small.

Therefore, in order to reduce the possibility of a clip to occur or reduce clipping noise so as to respond to a case where the clip is chronically generated or a case where large clipping noise is generated, or the like, the positional relationship of the plurality of microphones and the speaker, or the positions of the plurality of microphones themselves or the position of the speaker itself can be changed, and the accuracy of voice recognition in the subsequent stage can be improved.

Further, a signal processing method according to the embodiment includes an echo cancellation procedure to perform an echo cancellation process of canceling an output signal component from a speaker on signals from a plurality of microphones, a clip detection procedure to perform a clip detection for signals from the plurality of microphones, and a clip compensation procedure to compensate for a signal after the echo cancellation process of clipped one of the microphones on the basis of a signal of non-clipped one of the microphones.

With the signal processing method as such an embodiment, operation and effect similar to those of the signal processing device as the embodiment described above can be obtained.

Here, the functions of the voice signal processing unit 17 as has been described (particularly the functions related to echo cancellation, clip detection, and clip compensation) can be achieved as software processes by CPU or the like. The software processes are executed on the basis of a program, and the program is stored in a storage device readable by a computer device (information processing device) such as a CPU.

The program as an embodiment is a program executed by an information processing device, the program causing the information processing device to implement functions including an echo cancellation function to perform an echo cancellation process of canceling an output signal component from a speaker on signals from a plurality of microphones, a clip detection function to perform a clip detection for signals from the plurality of microphones, and a clip compensation function to compensate for a signal after the echo cancellation process of clipped one of the microphones on the basis of a signal of non-clipped one of the microphones.

With such a program, the signal processing device as the embodiment described above can be achieved.

Note that effects described in the present description are merely examples and are not limited, and other effects may be provided.

<9. Present Technology>

Note that the present technology can also have configurations as follows.

(1)

A signal processing device including:

an echo cancellation unit that performs an echo cancellation process of canceling an output signal component from a speaker on signals from a plurality of microphones;

a clip detection unit that performs a clip detection for signals from the plurality of microphones; and a clip compensation unit that compensates for a signal after the echo cancellation process of clipped one of the microphones on the basis of a signal of non-clipped one of the microphones.

(2)

The signal processing device according to (1) above, in which the clip compensation unit compensates for a signal of the clipped microphone by suppressing the signal.

(3)

The signal processing device according to (2) above, in which the clip compensation unit suppresses a signal of the clipped microphone on the basis of an average power ratio between a signal of the non-clipped microphone and a signal of the clipped microphone.

(4)

The signal processing device according to (3) above, in which the clip compensation unit uses, as the average power ratio, an average power ratio with a signal of the microphone having a minimum average power among the signals of the non-clipped microphones is used.

(5)

The signal processing device according to any one of (1) to (4) above, in which the clip compensation unit adjusts a suppression amount of a signal of the clipped microphone according to a speech level in a case where a user speech is present and a speaker output is present.

(6)

The signal processing device according to any one of (1) to (5) above, in which the clip compensation unit suppresses a signal of the clipped microphone by a suppression amount according to a characteristic of a voice recognition process in a subsequent stage in a case where a user speech is present and no speaker output is present.

(7)

The signal processing device according to any one of (1) to (5) above, in which the clip compensation unit does not perform the compensation for the clipped microphone signal in a case where a user speech is present and no speaker output is present.

(8)

The signal processing device according to any one of (1) to (7) above, further including:

a drive unit that changes a position of at least one of the plurality of microphones or the speaker; and a control unit that changes the position of at least one of the plurality of microphones or the speaker by the drive unit in response to detection of a clip by the clip detection unit.

REFERENCE SINGS LIST

1 Signal processing device
11 Casing
12 Microphone array
13 Microphone
14 Movable unit
15 Display unit
16 Speaker
30 Clip detection unit
32 AEC processing unit
32*a* Echo cancellation processing unit
32*b* Double talk evaluation unit
33 Clip compensation unit
35 Speech section estimation unit
36 Speech direction estimation unit
37 Voice emphasis unit
38 Noise suppression unit

The invention claimed is:

1. A signal processing device comprises:

circuitry configured to function as:

an echo cancellation unit that performs an echo cancellation process of canceling an output signal component from a speaker on signals from a plurality of microphones;

a clip detection unit that performs a clip detection for signals from the plurality of microphones; and a clip compensation unit that compensates for a signal after the echo cancellation process of a clipped one of the microphones on a basis of a signal of a non-clipped one of the microphones, wherein in a case where a user speech is present and no speaker output is present, the clip compensation unit does not compensate for the signal after the echo cancellation process of the clipped microphone.

2. The signal processing device according to claim 1, wherein the clip compensation unit compensates for a signal of the clipped microphone by suppressing the signal.

3. The signal processing device according to claim 2, wherein the clip compensation unit suppresses a signal of the clipped microphone on a basis of an average power ratio between a signal of the non-clipped microphone and a signal of the clipped microphone.

4. The signal processing device according to claim 3, wherein the clip compensation unit uses, as the average power ratio, an average power ratio with a signal of the microphone having a minimum average power among the signals of the non-clipped microphones is used.

5. The signal processing device according to claim 1, wherein the clip compensation unit adjusts a suppression amount of a signal of the clipped microphone according to a speech level in a case where a user speech is present and a speaker output is present.

6. The signal processing device according to claim 1, wherein the clip compensation unit suppresses a signal of the clipped microphone by a suppression amount according to a characteristic of a voice recognition process in a subsequent stage in a case where a user speech is present and no speaker output is present.

7. The signal processing device according to claim 1, the circuitry further configured to function as:

a drive unit that changes a position of at least one of the plurality of microphones or the speaker; and a control unit that changes the position of at least one of the plurality of microphones or the speaker by the drive unit in response to detection of a clip by the clip detection unit.

8. A signal processing method comprising:

an echo cancellation procedure to perform an echo cancellation process of canceling an output signal component from a speaker on signals from a plurality of microphones;

a clip detection procedure to perform a clip detection for signals from the plurality of microphones; and a clip compensation procedure to compensate for a signal after the echo cancellation process of a clipped one of the microphones on a basis of a signal of a non-clipped one of the microphones, wherein in a case where a user speech is present and no speaker output is present, the clip compensation procedure does not compensate for the signal after the echo cancellation process of the clipped microphone.

9. A non-transitory storage medium encoded with instructions that, when executed by a computer, execute processing comprising:

an echo cancellation function to perform an echo cancellation process of canceling an output signal component from a speaker on signals from a plurality of microphones;

a clip detection function to perform a clip detection for signals from the plurality of microphones; and a clip compensation function to compensate for a signal after the echo cancellation process of a clipped one of the microphones on a basis of a signal of a non-clipped one of the microphones, wherein the clip compensation function compensates for a signal of the clipped microphone by suppressing the signal, and wherein the clip compensation function suppresses a signal of the clipped microphone on a basis of an average power ratio between a signal of the non-clipped microphone and a signal of the clipped microphone.

* * * * *